United States Patent [19]

Zinke et al.

[11] Patent Number: 4,917,809

[45] Date of Patent: Apr. 17, 1990

[54] HIGH-TEMPERATURE LUBRICANTS

[75] Inventors: Horst Zinke, Ernsthofen, Fed. Rep. of Germany; Rolf Schumacher, Marly, Switzerland

[73] Assignee: Ciba-Geigy Corporation, Ardsley, N.Y.

[21] Appl. No.: 115,287

[22] Filed: Nov. 2, 1987

[30] Foreign Application Priority Data

Nov. 11, 1986 [CH] Switzerland ..... 4497/86

[51] Int. Cl.[4] ..... C10M 135/36

[52] U.S. Cl. ..... 252/32.7 E; 252/33.6; 252/34; 252/49.8; 252/75; 252/78.1; 252/78.5

[58] Field of Search ..... 252/32.7 E, 75, 78.1, 252/78.5, 49.8, 33.6, 34, 47

[56] References Cited

U.S. PATENT DOCUMENTS

| | | | |
|---|---|---|---|
| 3,779,919 | 12/1973 | Patmore et al. | 252/33.6 |
| 3,897,351 | 7/1975 | Davis et al. | 252/34 |
| 3,933,658 | 1/1976 | Beiswanger et al. | 252/46.6 |
| 3,966,623 | 6/1976 | Krug et al. | 252/47 |
| 4,096,077 | 6/1978 | Swakon | 252/33.6 |
| 4,104,179 | 8/1978 | Colclough | 252/32.7 E |
| 4,532,062 | 7/1985 | Ryer et al. | 252/47 |
| 4,589,991 | 5/1986 | Ryer et al. | 252/47 |
| 4,737,302 | 4/1988 | Camenzind et al. | 252/47 |
| 4,741,847 | 5/1988 | Cargnino et al. | 252/34 |

FOREIGN PATENT DOCUMENTS

| | | |
|---|---|---|
| 150957 | 8/1985 | European Pat. Off. . |
| 207737 | 1/1987 | European Pat. Off. . |

OTHER PUBLICATIONS

Smalheer & Smith, "Lubricant Additives", 1967.

*Primary Examiner*—William R. Dixon Jr.
*Assistant Examiner*—Ellen M. McAvoy
*Attorney, Agent, or Firm*—Luther A. R. Hall

[57] ABSTRACT

A composition comprising (a) one or more lubricants or hydraulic based on mineral oil or synthetic oils and (b) 0.05 to 5% by weight, relative to the total weight of the lubricant composition or hydraulic oil composition, of a mixture of (1) at least one compound of the formula I or II

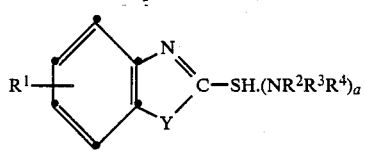

I

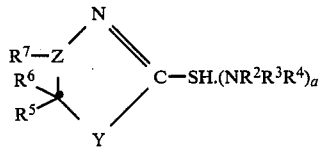

II in which Y, Z, $R^1$, $R^2$, $R^3$, $R^4$, $R^5$, $R^6$ and $R^7$ as well as a are as defined in patent claim 1 and (2) at least one compound of the formulae III or IV

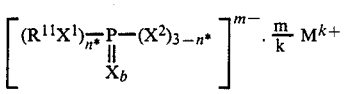

III

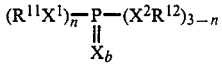

IV in which X, $X^1$, $X^2$, $R^{11}$, $R^{12}$, m, n, n*, k, b and M are as defined in patent claim 1.

18 Claims, No Drawings

HIGH-TEMPERATURE LUBRICANTS

The present invention relates to lubricant or hydraulic oil compositions which contain, as additives, a mixture of an oil-soluble 5-ring heterocyclic compound, which may be benzo-fused, with a tautomeric 2-mercapto-1,3-hetero-atom-aza group and a phosphorus compound, and to the use of these mixtures as additives in lubricants or hydraulic oils To improve the application properties, additives are usually added to mineral and synthetic lubricants. To improve the anti-wear properties, extreme-pressure additives and wear-reducing additives are added to the lubricants. These additives must meet the requirement of not having a corroding action on the metal components to be lubricated and having good heat resistance.

Various types of zinc dialkyl dithiophosphates (ZDTP) are used throughout the world as anti-wear additives.

The use of 5-ring heterocyclic compounds, which may be benzo-fused, with a tautomeric 2-mercapto-1,3-heteroatomaza group and, if appropriate, further nitrogen atoms in the ring system as lubricant additives is known. In general, however, these show only inadequate anti-wear properties, especially at higher temperatures.

Thus, aminobenzothiazole disulfides, for example, morpholinobenzothiazole disulfide, in combination with ZDTP are described as lubricant additives or motor fuel additives in DE-A No. 2,605,655.

In U.S. Pat. No. 3,966,623, the synergistic mixture of mercaptobenzothiazole amine salts with 2,5-dimercapto-1,3,4-thiadiazole disulfides as corrosion inhibitors in lubricating oils is described.

Moreover, EP-A No. 150,957 describes the use of mercaptozothiazole amine salt solutions in excess amine for improving the antioxidative and anticorrosive properties of power transmission fluids. In addition, rhodamine amine salts are known from U.S. Pat. No. 3,779,919 as additives for improving the load-bearing capacity of synthetic turbine oils.

It has now been found that mixtures of oil-soluble 5-ring heterocyclic compounds which have a tautomeric 2-mercapto-1,3-heteroatom-aza group and may be benzo-fused, or amine salts thereof, with various derivatives of phosphoric acid esters, thio-, dithio- or trithio-phosphoric acid esters or phosphorous acid esters have particularly good wear-reducing properties, especially at a higher temperature, coupled at the same time with a reduced P-content of the mixtures.

The present invention relates to a composition comprising (a) one or more lubricants or hydraulic oils based on mineral oil or synthetic oils and (b) 0.05 to 5% by weight, relative to the total weight of the lubricant composition or hydraulic oil composition, of a mixture of (1) at least one compound of the formula I or II

I

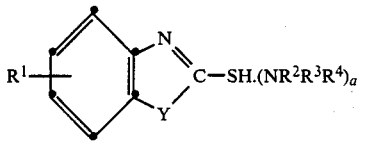

-continued

II

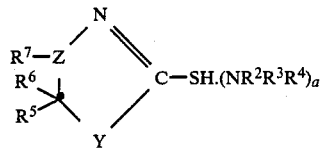

in which Y is —O—, —S—, —NH— or —$NR^9$—, with $R^9$ being $C_1$–$C_{12}$-alkyl, Z is —$CR^8$— or —N— and $R^1$ is hydrogen, $C_1$–$C_{12}$-alkyl, $C_1$–$C_4$-alkoxy, $C_2$–$C_{24}$-alkoxycarbonyl or nitro, $R^2$ is hydrogen or unsubstituted or OH-substituted $C_1$–$C_{24}$-alkyl, $R^3$ is hydrogen, $C_1$–$C_{24}$-alkyl or $C_2$–$C_{24}$-alkenyl, $R^4$ is $C_1$–$C_{24}$-alkyl or $C_2$–$C_{24}$-alkenyl, or $R^3$ and $R^4$ together are a —$C(R^{10})$=N-$CH_2$-$CH_2$- radical, with $R^{10}$ being hydrogen, $C_1$–$C_{17}$-alkyl or $C_2$–$C_{17}$-alkenyl, and $R^5$ is hydrogen, —SH or $C_1$–$C_{22}$-alkyl, $R^6$ is hydrogen, $R^7$ is hydrogen or $R^6$ and $R^7$ together are a direct bond, $R^8$ is hydrogen or $C_1$–$C_{22}$-alkyl or phenyl, or $R^7$ and $R^8$ together are carbonyl and a has the value 0 or 1 to 2, and (2) at least one compound of the formulae III or IV

III

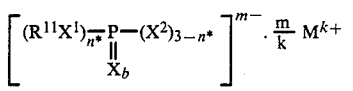

IV

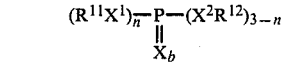

in which X, $X^1$ and $X^2$ independently of one another are oxygen or sulfur, $R^{11}$ and $R^{12}$ are identical or different and are each $C_1$–$C_{12}$-alkyl which may be interrupted by —O—, —S— or —C(O)O—, unsubstituted or $C_1$–$C_{12}$-alkyl-substituted phenyl or naphthyl, unsubstituted or $C_1$–$C_4$-alkyl-substituted $C_5$–$C_{12}$-cycloalkyl or $C_7$–$C_{13}$-aralkyl, and n is the number 1, 2 or 3, n* is the number 1 or 2, m is the number 1 or 2, k is the number 1 or 2 and b is the number 0 or 1, and, in the case of n or n* being 2 or also n being 3, the radicals $R^{11}$ are identical or different or two radicals $R^{11}$ can, together with the two heteroatoms $X^1$ and the P atom to which they are linked, form a 5-membered or 6-membered ring, and in which M is a k-valent metal cation, a proton or a compound $HN^{\oplus}R^{13}R^{14}R^{15}$, $R^{13}$ being hydrogen or unsubstituted or OH-substituted $C_1$–$C_{30}$-alkyl, $R^{14}$ being hydrogen or $C_1$–$C_{30}$-alkyl and $R^{15}$ being $C_1$–$C_{30}$-alkyl or $C_{18}$-alkenyl, or $R^{14}$ and $R^{15}$ together forming a -$C(R^{16})$=N—$CH_2$-$CH_2$— radical and $R^{16}$ being hydrogen, $C_1$–$C_{17}$-alkyl or $C_2$–$C_{17}$-alkenyl, with the proviso that, if m is 2 and k is 1, two different radicals M are possible.

$C_1$–$C_{12}$-Alkyl groups $R^1$, $R^9$, $R^{11}$ and $R^{12}$ are straight-chain or branched alkyl radicals, for example methyl, ethyl, n-propyl, isopropyl, n-butyl, isobutyl, sec.-butyl, tert.-butyl, straight-chain or branched pentyl, hexyl, heptyl, octyl, nonyl, decyl, undecyl and dodecyl.

$C_1$–$C_{17}$-Alkyl groups $R^{10}$ and $R^{16}$ are straight-chain or branched alkyl radicals, for example methyl, ethyl, n-propyl, isopropyl, n-butyl, isobutyl, sec.-butyl, tert.-butyl, straight-chain or branched pentyl, hexyl, heptyl, octyl, nonyl, decyl, undecyl, dodecyl, tridecyl, tetradecyl, pentadecyl, hexadecyl and heptadecyl.

$C_1$–$C_{22}$-Alkyl groups $R^5$ and $R^8$ are straight-chain or branched alkyl radicals, for example methyl, ethyl, n-propyl, isopropyl, n-butyl, isobutyl, sec.-butyl, tert.-butyl, straight-chain or branched pentyl, hexyl, heptyl, octyl, nonyl, decyl, undecyl, dodecyl, tridecyl, tetradecyl, pentadecyl, hexadecyl, heptadecyl, octadecyl, eicosyl, heneicosyl, and docosyl.

$C_1$–$C_{24}$-Alkyl groups $R^2$, $R^3$ and $R^4$ are straight-chain or branched alkyl radicals, for example methyl, ethyl, n-propyl, isopropyl, n-butyl, isobutyl, sec.-butyl, tert.-butyl, straight-chain or branched pentyl, hexyl, heptyl, octyl, nonyl, decyl, undecyl, dodecyl, tridecyl, tetradecyl, pentadecyl, hexadecyl, heptadecyl, octadecyl, eicosyl, heneicosyl, docosyl, tricosyl and tetracosyl.

$C_1$–$C_{30}$-Alkyl groups $R^{13}$, $R^{14}$ and $R^{15}$ are straight-chain or branched alkyl radicals, for example methyl, ethyl, n-propyl, isopropyl, n-butyl, isobutyl, sec.-butyl, tert.-butyl, straight-chain or branched pentyl, hexyl, heptyl, octyl, nonyl, decyl, undecyl, dodecyl, tridecyl, tetradecyl, pentadecyl, hexadecyl, heptadecyl, octadecyl, eicosyl, heneicosyl, docosyl, tricosyl, tetracosyl, pentacosyl, hexacosyl, octacosyl and triacontyl.

Hydroxy-substituted alkyl groups $R^2$ and $R^{13}$ are hydroxy mono- or -poly-substituted alkyl, the hydroxyl group being preferably terminal in the case of monosubstitution. This is in particular 2-hydroxyethyl.

In $C_1$–$C_{12}$-alkyl groups $R^{11}$ and $R^{12}$, which are interrupted by —O—, —S— or —C(O)O —, the heteroatom or the C(O)O group can be in any possible position, and the $C_1$–$C_{12}$-alkyl radical can be interrupted once or several times, and the interruption can be due to both identical or different heteroatoms and C(O)O groups. One interruption is preferred.

$C_2$–$C_{17}$-Alkenyl groups $R^{10}$ and $R^{16}$ and $C_2$–$C_{24}$-alkenyl groups $R^3$ and $R^4$ are straight-chain or branched alkenyl radicals which contain one or more, but preferably one double bond, for example vinyl, allyl, n-butenyl, 1,3-butadienyl, i-pentenyl, pentenyl, hexenyl, heptenyl, octenyl, nonenyl, decenyl, undecenyl, dodecenyl, tridecenyl, 2-nonyl-2-butenyl, tetradecenyl, pentadecenyl, hexadecenyl and 8-heptadecenyl. Furthermore, alkenyl $R^3$ and $R^4$ can also be, for example, 2-octadecenyl, oleyl, nonadecenyl, eicosenyl, heneicosenyl, docosenyl, tricosenyl and tetracosenyl. 8-Heptadecenyl and oleyl are preferred.

$C_1$–$C_4$-Alkoxy $R^1$ can be, for example, methoxy, ethoxy, isopropoxy or n-butoxy.

$C_2$–$C_{24}$ -Alkoxycarbonyl $R^1$ contains 1 –24 carbon atoms in the alkyl moiety and can be, for example, methoxycarbonyl, ethoxycarbonyl, propoxycarbonyl or 2-ethylhexyloxycarbonyl.

In $C_1$–$C_{12}$-alkyl-substituted phenyl or naphthyl $R^{11}$ and $R^{12}$, the phenyl or naphthyl radical can be monosubstituted or polysubstituted, but preferably monosubstituted to disubstituted; $C_1$–$C_{12}$-alkyl is, for example, methyl, ethyl, n-propyl, isopropyl, n-butyl, isobutyl, sec.-butyl, tert.-butyl, straight-chain or branched nonyl or dodecyl.

$C_5$–$C_{12}$-Cycloalkyl $R^{11}$ and $R^{12}$ is, for example, cyclopentyl, cyclohexyl, cycloheptyl, cyclooctyl, cyclononyl, cyclodecyl, cyclodecyl or cyclododecyl, and preferably cyclohexyl.

$C_1$–$C_4$-Alkyl-substituted $C_5$–$C_{12}$-cycloalkyl $R^{11}$ and $R^{12}$ can be monosubstituted or polysubstituted, but preferably monosubstituted; examples are methylcyclohexyl, trimethylcyclohexyl, butylcyclohexyl or propylcyclopentyl.

$C_7$–$C_{13}$-Aralkyl $R^{11}$ and $R^{12}$ is, for example, benzyl, 1- or 2-phenethyl, 3-phenylpropyl, α, α-dimethylbenzyl, 2-phenylisopropyl, 2-phenylhexyl, benzhydryl or naphthylmethyl, but preferably benzyl.

A k-valent metal cation M is, for example, $Li^{\oplus}$, $Na^{\oplus}$or $K^{\oplus}$in the case of k=1 and is $Mg^{2\oplus}$, $Ca^{2\oplus}$, $Ba^{2\oplus}$ or $Zn^{2\oplus}$ in the case of k=2. However, the preferred metal cation M is $Zn^{2\oplus}$.

Preferably, a has the value 0 or 1 to 1.25, and particularly preferably 0 or 1.2.

Those compositions are preferred in which, in the compounds of the formulae I or II, Y is oxygen or sulfur, but especially sulfur.

Those compositions are also preferred in which, in the compounds of the formula I, $R^1$ is hydrogen or $C_1$–$C_{12}$-alkyl, especially hydrogen or $C_1$–$C_4$-alkyl and very particularly $R^1$ is hydrogen.

Moreover, those compositions are preferred in which, in the compounds of the formula I, $R^1$ is hydrogen and Y is sulfur.

In addition, those compositions are of interest in which, in the compounds of the formula II, Z is —$CR^8$—.

Those compositions are also of interest in which, in the compounds of the formula II, $R^6$ is a direct bond together with $R^7$, or in which, in the compounds of the formula II, $R^5$ is hydrogen or —SH, especially hydrogen.

Those compositions are also of interest in which, in the compounds of the formulae I or II, $R^2$ is hydrogen or unsubstituted or OH-substituted $C_1$–$C_4$-alkyl, especially hydrogen or methyl; and also those in which, in the compounds of the formulae I or II, $R^3$ is hydrogen, $C_8$–$C_{24}$-alkyl or $C_8$–$C_{24}$-alkenyl; or in which, in the compounds of the formulae I or II, $R^4$ is $C_8$–$C_{24}$-alkyl or $C_8$–$C_{24}$-alkenyl.

Those compositions are of particular interest in which, in the compounds of the formulae I or II, $R^2$ is hydrogen and $R^3$ and $R^4$ independently of one another are $C_8$–$C_{24}$-alkyl or $C_8$–$C_{24}$-alkenyl; and also those in which, in the compounds of the formulae I or II, $R^2$ and $R^3$ are methyl and $R^4$ is $C_8$–$C_{24}$-alkyl or $C_8$–$C_{24}$-alkenyl; or those in which, in the compounds of the formulae I or II, $R^2$ and $R^3$ are hydrogen and $R^4$ is $C_8$–$C_{24}$-alkyl or $C_8$–$C_{24}$-alkenyl.

$C_8$–$C_{24}$-Alkyl radicals $R^3$ and $R^4$ are preferably branched $C_8$–$C_{24}$-alkyl radicals, in particular those which contain tertiary C atoms, and particularly preferably those with a tertiary C atom in the α-position to the N atom, to which they are linked. In the case of, for example, a primary amine $NR^2R^3R^4$, those mixtures of such amines are preferably used which are commercially available under the description "Primene". Thus, for example, the mixture "Primene® 81-R" (mainly branched alkylamines having 12 to 15 C atoms) or the mixture "Primene® JM-T" (mainly branched alkylamines having 18 to 24 C atoms) can be used.

Those compositions are also of interest in which, in the compounds of the formulae I or II, $R^2$ is 2-hydroxyethyl and $R^3$ together with $R^4$ is a —$C(R^{10})$=N—$CH_2CH_2$— radical, $R^{10}$ being hydrogen, $C_1$–$C_{17}$-alkyl or $C_2$–$C_{17}$-alkenyl, but preferably $C_8$–$C_{17}$-alkyl or $C_8$–$C_{17}$-alkenyl.

A further embodiment is represented by compositions in which, in the compounds of the formulae III or IV, $R^{11}$ is $C_1$–$C_{12}$-alkyl which may be interrupted by —O—, —S— or —C(O)O—, or phenyl or naphthyl which are unsubstituted or substituted by $C_1$–$C_{12}$-alkyl, especially $C_8$–$C_{12}$-alkyl, or cyclohexyl or benzyl, $R^{11}$ preferably being $C_3$–$C_{12}$-alkyl which may be interrupted by —C(O)O—, or phenyl or nonylphenyl.

An additional embodiment is represented by compositions in which, in the compounds of the formulae III or IV, $R^{12}$ is $C_1$–$C_{12}$-alkyl which may be interrupted by —O—, —S— or —C(O)O —, or phenyl or naphthyl which are unsubstituted or substituted by $C_1$–$C_{12}$-alkyl, especially $C_8$–$C_{12}$-alkyl, or cyclohexyl or benzyl, $R^{12}$ preferably being $C_3$–$C_{12}$-alkyl which may be interrupted by —C(O)O —, or phenyl or nonylphenyl.

Those compositions are also of interest in which, in the compounds of the formulae III or IV, X is oxygen, and also those in which, in the compounds of the formulae III or IV, $X^1$ and $X^2$ are oxygen, or those in which, in the compounds of the formulae III or IV, X and $X^2$ are sulfur and $X^1$ is oxygen.

Moreover, those compounds are of interest in which, in the compounds of the formula III, M is a proton, $Zn^{2+}$or $HN^{\oplus}R^{13})(R^{14})(R^{15})$ Those compositions are of particular interest in which, in the compounds of the formula III, X and $X^2$ are sulfur, $X^1$ is oxygen, $R^{11}$ is $C_3$–$C_8$-alkyl, n* is 2, m is 1 and M is $Zn^{2+}$; or those in which, in the compounds of the formula III, X, $X^1$ and $X^2$ are oxygen, $R^{11}$ is $C_2$–$C_6$-alkyl, n* is 1 or 2, m is 2 or 1 and, in the case of m=1, M is $HN^{\oplus}R^{13})(R^{14})(R^{15})$ and, in the case of m=2, M is $HN^{\oplus}R^{13})(R^{14})(R^{15})$ or a proton, with the proviso that at most one radical M is a proton, $R^{13}$ being preferably hydrogen and $R^{14}$ and $R^{15}$ independently of one another being $C_8$–$C_{24}$-alkyl.

Those compositions are of additional interest in which, in the compounds of the formulae III or IV, X is sulfur, and also those in which, in the compounds of the formulae III or IV, X is sulfur and $X^1$ and $X^2$ are oxygen; or those in which, in the compounds of the formulae III or IV, X is oxygen and $X^1$ and $X^2$ are sulfur.

Those compositions are also of interest in which, in the compounds of the formula III, $R^{13}$ is 2-hydroxyethyl and $R^{14}$ together with $R^{15}$ is a —C($R^{16}$)=N—$CH_2$–$CH_2$— radical, $R^{16}$ preferably being $C_8$–$C_{17}$-alkyl or $C_8$–$C_{17}$-alkenyl.

Those compositions are preferred in which the mixture b) consists of (1) one compound of the formulae I or II and (2) one compound of the formula III.

Those compositions are particularly preferred in which, in the compounds of the formulae I or II, a has the value 0, Y is sulfur or oxygen, but preferably sulfur, and, in the formula I, $R^1$ is hydrogen and, in the compounds of the formula III, X, $X^1$ and $X^2$ are oxygen, $R^{11}$ is $C_2$–$C_6$-alkyl, n* is the number 1 or 2, m is the number 2 or 1 and, in the case of m=1, M is $HN^{\oplus}R^{13})(R^{14})(R^{15})$ and, in the case of m=2, M is $HN^{\oplus}(R^{13})(R^{14})(R^{15})$ or a proton, with the proviso that at most one radical M is a proton.

Those compositions are also preferred in which, in the compounds of the formulae I or II, a has the value 1 to 1.25, Y is sulfur or oxygen, but preferably sulfur, and, in the formula I, $R^1$ is hydrogen and, in the compounds of the formula III, X and $X^2$ are sulfur, $X^1$ is oxygen, $R^{11}$ is $C_3$–$C_8$-alkyl, n* is the number 2, m is the number 1 and M is $Zn^{2+}$, Those compositions are very particularly preferred in which the mixture (b) consists of (1) one compound of the formula I and (2) one compound of the formula III.

Those compositions are especially preferred in which, in the compounds of the formula I, a has the value 1 to 1.25, Y is sulfur, $R^1$ is hydrogen, $R^2$ is hydrogen, $R^3$ is hydrogen or $C_8$–$C_{24}$-alkyl and $R^4$ i alkyl and, in the compounds of the formula I, $X^2$ are sulfur, $X^1$ is oxygen, $R^{11}$ is $C_3$–$C_8$-alkyl. number 2, m is the number 1 and M is $Zn^{2+}$.

The components of the mixtures (b), whic used according to the invention, are known. T ocyclic compounds are commercially availab readily be prepared by generally known me organic chemistry from commercial produc amine salts are obtained in the conventional m addition of the corresponding amine (salt fo An excess of the amine can also be used here (a preparation of the phosphorus compounds is d for example, in Houben-Weyl "Methoden der hen Chemie [Methods of organic chemistry]" 12, part 2, 4th edition, G. Thieme Verlag, 1964, on pages 53–77, 143–210, 226–274, 299-587–748. Their amine salts are prepared analo those of the heterocyclic compounds.

The mixtures (b) are prepared by methods k se, for example by simple mixing. Thus, for 2-mercaptobenzothiazole can be incorporate commercially available amine phosphate (ami monoesters/diesters of phorphoric acid).

The mixtures (b) are of a liquid nature, but h ing viscosities. They are outstandingly suitabl lent anti-wear additives for lubricants and oils, preferably for lubricants. The mixtures a to the invention deploy their full effectiver cially at high temperatures.

The present invention therefore also relates of mixtures of (1) at least one compound of the I or II and (2) at least one compound of the for or IV as wear-reducing additives for lubrica draulic oils.

The mixtures (b) are soluble in lubricants an lic oils in an adequate quantity and are empl concentration from 0.05 to 5% by weight, pre a concentration from 0.1 to 3% by weight, r the total weight of the lubricant composition o lic oil composition.

The (1):(2) ratio is, for example, 10:1 to 1:1 bly 5:1 to 1:10 and particularly preferably especially 1:1 to 1:3.

The mixtures can be added as such to the lub the components, for example 2-mercaptoben amine salts and the phosphorus compound, c pared separately and added to the lubricant during formulation. In the case of highly vis tures, dilution with, for example, an appropria represents an advantageous form for making The lubricants or hydraulic oils in question iar to those skilled in the art and are desc example, in the "Schmiermittel Taschenbuc cants Handbook]" (Hüthig Verlag, Heidelbe or in "Ullmanns Encyclopädie der technische [Ullmann's Encyclopedia of Industrial Ch volume 13, pages 85–94 (Verlag Chemie, 1977).

Particularly suitable examples, apart fro oils, are poly-α-olefins, ester-based lubrica phate esters, glycols, polyglycols and polyalk cols.

Moreover, the lubricants can contain other added for even further improvement of the b erties of lubricants and hydraulic oils; the antioxidants, metal passivators, rust inhibitors, index improvers, pour point depressants, d

BEST AVAILABLE COPY

BEST AVAILABLE COPY detergents, extreme-pressure additives and other anti-wear additives.

Examples of phenolic antioxidants

1. Alkylated monophenols 2,6-di-tert-Butyl-4-methylphenol, 2,6-di-tert-butylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-di-cyclopentyl-4-methylphenol, 2-(α-methylcyclohexyl)-4,6-dimethylphenol, 2,6-di-octadecyl-4-methylphenol, 2,4,6-tricyclohexylphenol, 2,6-di-tert-butyl-4-methoxymethylphenol and o-tert-butylphenol.

2. Alkylated hydroquinones 2,6-di-tert-Butyl-4-methoxyphenol, 2,5-di-tert-butylhydroquinone, 2,5-di-tert-amyl-hydroquinone and 2,6-diphenyl-4-octadecyloxyphenol.

3. Hydroxylated thiodiphenyl ethers 2,2'-Thio-bis-(6-tert-butyl-4-methylphenol), 2,2'-thio-bis-(4-octylphenol), 4,4'-thio-bis-(6-tert-butyl-3-methylphenol) and 4,4'-thio-bis-(6-tert-butyl-2-methylphenol).

4. Alkylidene-bisphenols 2,2'-Methylene-bis-(6-tert-butyl-4-methylphenol), 2,2'-methylene-bis-(6-tert-butyl-4-ethylphenol), 2,2'-methy-lene-bis-[4-methyl-6-(α-methylcyclohexyl)-phenol], 2,2'- methylene-bis-(4-methyl-6-cyclohexylphenol), 2,2'-methylene-bis-(6-nonyl-4-methylphenol), 2,2'-methylene-bis-(4,6-di-tert-butylphenol), 2,2'-ethylidene-bis-(4,6-di-tert-butylphenol), 2,2'-ethylidene-bis-(6-tert-butyl-4-iso-butylphenol), 2,2'-methylene-bis-[6-(α-methylbenzyl)-4-nonylphenol], 2,2'-methylene-bis-[6-(α,α-dimethylbenzyl)-4-nonylphenol], 4,4'-methylene-bis-(2,6-di-tert-butylphenol), 4,4'-methylene-bis-(6-tert-butyl-2-methylphenol), 1,1-bis-(5-tert-butyl-4-hydroxy-2-methylphenyl)-butane, 2,6-di-(3-tert-butyl-5-methyl-2-hydroxybenzyl)-4-methylphenol, 1,1,3-tris-(5-tert-butyl-4-hydroxy-2-methylphenyl)-3-n-dodecylmercaptobutane, ethylene glycol bis-[3,3-bis-(3'-tert-butyl-4'-hydroxyphenyl)-butyrate], di-(3-tert-butyl-4-hydroxy-5-methylphenyl)-dicyclopentadiene, di-[2-(3'-tert-butyl-2'-hydroxy-5'-methyl-benzyl)-6-tert-butyl-4-methyl-phenyl]terephthalate.

5. Benzyl compounds 1,3,5-Tri-(3,5-di-tert-butyl-4-hydroxybenzyl)-2,4,6-trimethylbenzene, di-(3,5-di-tert-butyl-4-hydroxybenzyl) sulfide, isooctyl 3,5-di-tert-butyl-4-hydroxybenzylmercapto acetate, bis-(4-tert-butyl-3-hydroxy-2,6-dimethylbenzyl) dithiol terephthalate, 1,3,5-tris-(3,5-di-tert-butyl-4-hydroxybenzyl) isocyanurate, 1,3,5-tris-(4-tert-butyl-3-hydroxy-2,6-dimethylbenzyl) isocyanurate, dioctadecyl 3,5-di-tert-butyl-4-hydroxybenzyl-phosphonate and the calcium salt of monoethyl 3,5-di-tert-butyl-4-hydroxybenzyl-phosphonate.

6. Acylaminophenols

Lauric acid 4-hydroxyanilide, stearic acid 4-hydroxyanilide, 2,4-bis-octylmercapto-6-(3,5-di-tert-butyl-4-hyd-roxyanilino)-s-triazine and octyl N-(3,5-di-tert-butyl-4-hydroxyphenyl)-carbamate.

7. Esters of β-(3,5-di-tert-butyl-4-hydroxyphenyl)-propionic acid with monohydric or polyhydric alcohols, for example with methanol, octadecanol, 1,6-hexanediol, neopentyl glycol, thiodiethylene glycol, diethylene glycol, triethylene glycol, pentaerythritol, tris-hydroxyethyl isocyanurate and di-hydroxyethyl-oxamide.

8. Esters of β-(5-tert-butyl-4-hydroxy-3-methylphenyl)propionic acid with monohydric or polyhydric alcohols, for example with methanol, octadecanol, 1,6-hexanediol, neopentyl glycol, thiodiethylene glycol, diethylene glycol, triethylene glycol, pentaerythritol, tris-hydroxyethyl isocyanurate and di-hyd- roxyethyl-oxamide.

9. Amides of β-(3,5-di-tert-butyl-4-hydroxyphenyl)-propionic acid, for example N,N'-di-(3,5-di-tert-butyl-4-hydroxyphenylpropionyl)-hexamethylenediamine, N,N'-di-(3,5-di-tert-butyl-4-hydroxyphenyl-propionyl)-trimethylenediamine and N,N'-di-(3,5-di-tert-butyl-4-hydroxyphenylpropionyl)-hydrazine.

Examples of amine-type antioxidants

N,N'-Di-isopropyl-p-phenylenediamine, N,N'-di-sec-butyl-p-phenylenediamine, N,N'-bis(1,4-dimethyl-pentyl)-p-phenylenediamine, N,N'-bis(1-ethyl-3-methyl-pentyl)-p-phenylenediamine, N,N'-bis(1-methyl-heptyl)-p-phenylenediamine, N,N'-diphenyl-p-phenylenediamine, N,N'-di-(naphthyl-2)-p-phenylenediamine, N-isopropyl-N'-phenyl-p-phenylenediamine, N-(1,3-dimethyl-butyl)-N'-phenyl-p-phenylenediamine, N-(1-methyl-heptyl)-N'-phenyl-p-phenylenediamine, N-cyclohexyl-N'-phenyl-p-phenylenediamine, 4-(p-toluene-sulfonamido)-diphenylamine, N,N'-dimethyl-N,N'-di-sec-butyl-p-phenylenediamine, diphenylamine, 4-isopropoxy-diphenylamine, N-phenyl-1-naphthylamine, N-phenyl-2-naphthylamine, octylated diphenylamine, 4-n-butylaminophenol, 4-butyrylamino-phenol, 4-nonanoylaminophenol, 4-dodecanoylamino-phenol, 4-octadecanoylamino-phenol, di-(4-methoxy-phenyl)-amine, 2,6-di-tert-butyl-4-dimethyl- amino-methylphenol, 2,4'-diamino-diphenylmethane, 4,4'-diamino-diphenylmethane, N,N,N',N'-tetramethyl-4,4'-diaminodiphenylmethane, 1,2-di-[(2-methyl-phenyl)-amino]-ethane, 1,2-di-(phenylamino)-propane, (o-tolyl)-biguanide, di-[4-(1',3'-dimethyl-butyl)-phenyl)-amine, tert-octylated N-phenyl-1-naphthylamine and a mixture of monoalkylated and dialkylated tert-butyl/tert-octyl-diphenylamines.

Examples of metal passivators are for copper, for example triazole, benzotriazole and derivatives of these, salicylidene-propylenediamine and salts of salicylaminoguanidine.

Examples of rust inhibitors are (a) organic acids, their esters, metal salts and anhydrides, for example: N-oleoyl-sarcosine, sorbitan monooleate, lead naphthenate, dodecenylsuccinic anhydride, alkenylsuccinic acid half esters and 4-nonylphenoxyacetic acid.

(b) Nitrogenous compounds, for example:

I. Primary, secondary or tertiary aliphatic or cycloaliphatic amines and amine salts of organic and inorganic acids, for example oil-soluble alkylammonium carboxylates.

II. Heterocyclic compounds, for example: substituted imidazolines and oxazolines.

(c) Phosphorus-containing compounds, for example: amine salts of phosphoric acid partial esters.

(d) Sulfur-containing compounds, for example: barium dinonylnaphthalenesulfonates and calcium petroleum-sulfonates.

Examples of viscosity index improvers are polymethacrylates, vinylpyrrolidone/methacrylate copolymers, polybutenes, olefin copolymers and styrene/acrylate copolymers.

Examples of pour point depressants are polymethacrylate and alkylated naphthalene derivatives.

Examples of dispersants/surfactants are polybutenylsuccinmides, polybutenylphosphonic acid derivatives and basic magnesium, calcium and barium sulfonates and phenolates.

Examples of anti-wear additives are compounds containing sulfur and/or phosphorus and/or halogen, such as sulfurated vegetable oils, zinc dialkyl dithiophosphates, tritolyl phosphate, chlorinated paraffins, alkyl disulfides and aryl disulfides.

In the examples which follow, parts and percentages relate to the weight, unless otherwise stated.

EXAMPLES 1–9

The amine salts shown in Table 1 which follows are obtained by combining appropriate molar proportions of the heterocyclic mercapto compound with an amine.

TABLE 1

| Example | Heterocyclic mercapto compound | Amine | SH compound/ amine molar ratio | Physical data M.p./$n_D^{20}$ |
|---|---|---|---|---|
| 1 | 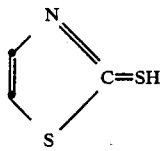 | $H_2N$-tert.-$C_{12/14}H_{25/29}$[1] | 1:1.2 | dark viscous liquid |
| 2 | 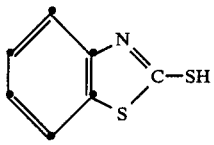 | $HN[CH_2-CH(CH_2-CH_3)-CH_2-CH_2-CH_2-CH_3]_2$ | 1:1.2 | M.p. 52–55° C. |
| 3 | 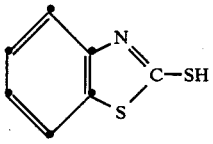 | $H_2N$-tert.-$C_{12/14}H_{25/29}$[1] | 1:1.2 | 1.5713 |
| 4 | 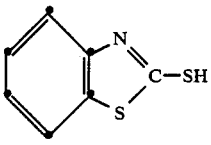 | $H_2N$-tert.-$C_{18/22}H_{37/45}$[2] | 1:1.2 | 1.5379 |
| 5 | 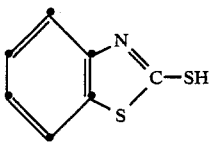 | $H_2N-C_{18}H_{35}$ | 1:1.2 | M.p. 47–52° C. |
| 6 | 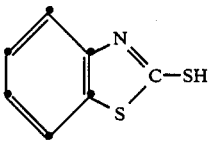 | $H_2N$-tert.-$C_{12/14}H_{25/29}$[1] | 1:1.2 | 1.5440 |
| 7 | 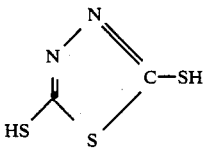 | $H_2N$-tert.-$C_{18/24}H_{37/45}$[2] | 1:1.2 | 1.5543 |

TABLE 1-continued

| Example | Heterocyclic mercapto compound | Amine | SH compound/ amine molar ratio | Physical data M.p./$n_D^{20}$ |
|---|---|---|---|---|
| 8 | 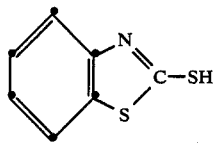 | 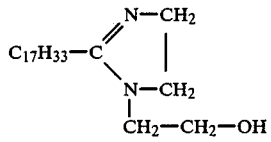 | 1:1.2 | 1.5569 |
| 9 | 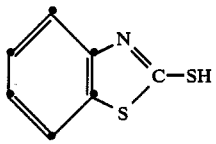 | $HN[C_{13}H_{27}]_2$ | 1:1.2 | 1.5297 |

(1)Primene ®81-R (Rohm and Haas)
(2)Primene ®JM-T (Rohm and Haas)

EXAMPLES 10–14

The mixtures shown in Table 2 are obtained analogously to Examples 1–9 by adding an appropriate phosphorus compound to a heterocyclic mercapto compound.

TABLE 2

| Example | Heterocyclic mercapto compound | P compounds | Mixing ratio | $n_D^{20}$ |
|---|---|---|---|---|
| 10 | 2-Mercaptobenzo-thiazole | Monohexyl/dihexyl phosphate/ tetramethylnonylamines[3] | 1:3 | 1.5240 |
| 11 | 2,5-Dimercapto-1,3,4-thiadiazole | Dioctyl phosphite | 1:9 | 1.4645 |
| 12 | 2-Mercapto-4-methyl-1,3-thiazole | O,O-Diisopropyl S-carbohexoxymethyl thiophosphate | 1:9 | 1.4790 |
| 13 | 3-Mercaptobenzo-thiazole | Monononyl-/dinonyl-phenyl phosphite/ N-di-2-ethylhexylamine | 15:85 | 1.5362 |
| 14 | 3-Mercapto-4-methyl-1,2,4-triazole | Dibutyl phosphite | 1:9 | 1.4415 |

[3]CAS-Registry No. 80939-62-4

EXAMPLES 15–24

The mixtures shown in Table 3 are prepared by adding compounds from Table 1 to phosphorus compounds.

TABLE 3

| Example | Product according to Example | P compounds | Further additives | Mixing ratio | $n_D^{20}$ |
|---|---|---|---|---|---|
| 15 | 3 | O,O-Diisopropyl S-2-carboethoxyethyl dithiophosphate | — | 1:1 | 1.5318 |
| 16 | 9 | Monohexyl/dihexyl phosphate/tetra-methylnonylamines[3] | — | 1:1 | 1.4952 |
| 17 | 4 | Zinc dialkyl dithiophosphate (ZDTP) | Antioxidant[4] | 2:3:2 | 1.5404 |
| 18 | 4 | S,S,S-Tris-carbo-2-ethylhexoxymethyl trithiophosphate | Antioxidant[4] | 2:1:1 | 1.5366 |
| 19 | 4 | S,S,S-Tris-carbo-2-ethylhexoxymethyl trithiophosphate | Antioxidant[4] | 1:1:1 | 1.5357 |
| 20 | 8 | Dioctyl phosphite | — | 1:1 | 1.4992 |
| 21 | 5 | Dioctyl phosphite | — | 1:1 | 1.5044 |
| 22 | 9 | Triphenyl thionophosphate | — | 1:1 | |
| 23 | 3 | Monohexyl/dihexyl phosphate/tetra-methylnonylamines[3] | — | 1:1 | |
| 24 | 3 | Zinc dialkyl dithiophosphate (ZDTP) | — | 1:1.5 | |

[3]CAS-Registry No. 80939-62-4
[4]Mixture of monoalkylated and dialkylated tert.-butyl/tert.-octyldiphenylamines.

EXAMPLE 25

The mixtures (b) are tested under various loadings in a shell 4-ball tester in a paraffinic base oil according to DIN 51,350 part 3. The wear scar diameter WSD is taken as a measure of the wear.

| Test | Example No. | Conc. [%] | Loading | Time [min] | WSD [mm] |
|---|---|---|---|---|---|
| 1 | 16 | 1 | 1000 | 5 | 0.71 |
| 2 | 16 | 1 | 1300 | 10 | 0.47 |
| 3 | 22 | 1 | 1300 | 5 | 1.9 |
| 4 | 22 | 1 | 800 | 5 | 0.83 |

EXAMPLE 26

The anti-wear effect is determined by means of a commercial oscillating friction apparatus from Optimol GmbH, Munich. (R. Schumacher et al. ASLE Transaction 26, 1 (1983), 94–101).

This apparatus is based on the following principle: a steel ball (100 Cr 6) subject to a force $F_N$ oscillates on a steel cylinder. The ball is fixed in a holder and accordingly executes an oscillating sliding motion. The horizontal and vertical forces are determined by a piezoelectric force sensor. Under the present test conditions, the maximum Herz normal stress is 2740 N/mm$^2$ and the maximum shear stress is 850 N/mm$^2$. The ball and the cylinder have been made of the same tool steel.

A few drops of oil, which contains the compound to be tested in solution, are applied between the cylinder and the ball. The following test conditions are chosen: Loading: 200 N, frequency: 50 Hz, amplitude: 1000 $\mu$, temperature: 130°–150° C., test period: 2 hours. Test oil: ISO VG 100 polyalphaolefin, S content <1.5 ppm.

To characterize the wear, a transverse profile is taken by means of a stylus instrument (Talysurf from Rank Taylor Hobson, Leicester, England). The integrated transverse profile area is taken as a measure of wear. The values given represent a relative measure of wear. The true wear value is calculated by multiplication with the factor $F=2\times10^4$.

| Additive | Concentration [%] | Wear: mm$^2$ 130° C. | 150° C. |
|---|---|---|---|
| Example 22 | 2 | 8.9 | 24.8 |

EXAMPLE 27

Procedure as in Example 26. Test temperatures 100° C., 120° C., 150° C.

| Additive | Concentration [%] | Wear: mm$^2$ 100° C. | 130° C. | 150° C. |
|---|---|---|---|---|
| Example 23 | 2 | 4.4 | 2.2 | 3.3 |

EXAMPLE 28

Procedure as in Example 26. Test temperatures 130° C.–150° C. Test oil I: Paraffin-type base oil ISO VG 32 with commercially available additives 0.75% of zinc dialkyl dithiophosphate (ZDTP)

11% of detergent

6% of viscosity index improver

Test oil II: Test oil I +0.5% of Example 3.

Test oil II thus contains Example 24 as the mixture b).

| Temperature [°C.] | Wear: mm$^2$ Test oil I | Test oil II |
|---|---|---|
| 130 | 11.1 | 1.4 |
| 140 | 19.3 | 2.8 |
| 150 | >25.0 | 4.5 |

What is claimed is:

1. A composition consisting essentially of (a) one or more lubricants or hydraulic oils based on mineral oil or synthetic oils and (b) 0.05 to 5% by weight, relative to the total weight of the lubricant composition or hydraulic oil composition, of a mixture of (1) at least one compound of the formula I or II

I

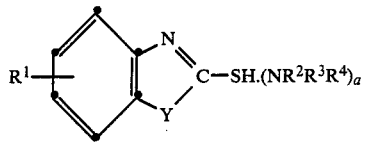

II

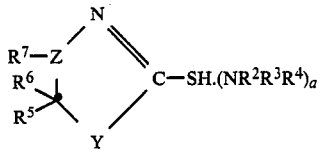

in which Y is —O—, —S—, —NH— or —NR$^9$—, with R$^9$ being C$_1$–C$_{12}$-alkyl, Z is —CR$^8$— or —N— and R$^1$ is hydrogen, C$_1$–C$_{12}$-alkyl, C$_1$–C$_4$-alkoxy, C$_2$–C$_{24}$-alkoxycarbonyl or nitro, R$^2$ is hydrogen or unsubstituted or OH-substituted C$_1$–C$_{24}$-alkyl, R$^3$ is hydrogen, C$_1$–C$_{24}$-alkyl or C$_2$–C$_{24}$-alkenyl, R$^4$ is C$_1$–C$_{24}$-alkyl or C$_2$–C$_{24}$-alkenyl, or R$^3$ and R$^4$ together are a —C(R$^{10}$)=N—CH$_2$–CH$_2$-radical, with R$^{10}$ being hydrogen, C$_1$–C$_{17}$-alkyl or C$_2$–C$_{17}$-alkenyl, and R$^5$ is hydrogen, —SH or C$_1$–C$_{22}$-alkyl, R$^6$ is hydrogen, R$^7$ is hydrogen or R$^6$ and R$^7$ together are a direct bond, R$^8$ is hydrogen or C$_1$–C$_{22}$-alkyl or phenyl, or R$^7$ and R$^8$ together are carbonyl and a has the value 0 or 1 to 2, and (2) at least one compound of the formulae III or IV

III $$\left[(R^{11}X^1)_{n^*}\underset{\underset{X_b}{\|}}{P}-(X^2)_{3-n^*}\right]^{m-}\cdot\frac{m}{k}M^{k+}$$

IV $$(R^{11}X^1)_n\underset{\underset{X_b}{\|}}{P}-(X^2R^{12})_{3-n}$$

in which X, X$^1$ and X$^2$ independently of one another are oxygen or sulfur, R$^{11}$ and R$^{12}$ are identical or different and are each C$_1$–C$_{12}$-alkyl which may be interrupted by —O—, —S— or —C(O)O—, unsubstituted or C$_1$–C$_{12}$-alkyl-substituted phenyl or naphthyl, unsubstituted or C$_1$–C$_4$-alkyl-substituted C$_5$–C$_{12}$-cycloalkyl or C$_7$–C$_{13}$-aralkyl, and n is the number 1, 2 or 3, n* is the number 1 or 2, m is the number 1 or 2, k is the number 1 or 2 and b is the number 0 or 1, and, in the case of n or n* being 2 or also n being 3, the radicals R$^{11}$ are identical or different or two radicals R$^{11}$ can, together with the two heteroatoms X$^1$ and the P atom to which they are linked, form a 5-membered or 6-membered ring, and in which M is a k-valent metal cation, a proton or a compound HN+R$^{13}$R$^{14}$R$^{15}$, R$^{13}$ being hydrogen or unsubstituted or OH-substituted C$_1$–C$_{30}$-alkyl, R$^{14}$ being hydrogen or C$_1$–C$_{30}$-alkyl and R$^{15}$ being C$_1$–C$_{30}$-alkyl or C$_{18}$-alkenyl, or R$^{14}$ and R$^{15}$ together forming a -C(R$^{16}$)=N—CH$_2$–CH$_2$— radical and R$^{16}$ being hydrogen, C$_1$–C$_{17}$-alkyl or C$_2$–C$_{17}$-alkenyl, with the proviso that, if m is 2 and k is 1, two different radicals M are possible.

2. A composition according to claim 1, wherein, in the formula I, R$^1$ is hydrogen and Y is —S—.

3. A composition according to claim 1, wherein, in the formula II, R$^6$ together with R$^7$ is a direct bond.

4. A composition according to claim 1, wherein, in the formulae I or II, $R^2$ is hydrogen or unsubstituted or OH-substituted $C_1$–$C_4$-alkyl.

5. A composition according to claim 1, wherein, in the formulae I or II, $R^2$ is hydrogen and $R^3$ and $R^4$ independently of one another are each $C_8$–$C_{24}$-alkyl or $C_8$–$C_{24}$-alkenyl.

6. A composition according to claim 1, wherein, in the formulae I or II, $R^2$ and $R^3$ are hydrogen and $R^4$ is $C_8$–$C_{24}$-alkyl or $C_8$–$C_{24}$-alkenyl.

7. A composition according to claim 1, wherein, in the formulae I or II, $R^2$ is 2-hydroxyethyl and $R^3$ together with $R^4$ is a $-C(R^{10})=N-CH_2-CH_2-$ radical.

8. A composition according to claim 1, wherein, in the formulae III or IV, $R^{11}$ is $C_1$–$C_{12}$-alkyl which may be interrupted by —O—, —S— or —C(O)O, or unsubstituted or $C_1$–$C_{12}$-alkyl-substituted phenyl or naphthyl, or cyclohexyl or benzyl.

9. A composition according to claim 1, wherein, in the formulae III or IV, $R^{12}$ is $C_1$–$C_{12}$-alkyl which may be interrupted by —O—, —S— or —C(O)O—, or unsubstituted or $C_1$–$C_{12}$-alkyl-substituted phenyl or naphthyl, or cyclohexyl or benzyl.

10. A composition according to claim 1, wherein, in the formula III, M is a proton, $Zn^{2+}$or $HN^{\oplus}(R^{13})(R^{14})(R^{15})$ 11. A composition according to claim 1, wherein, in the formula III, X and $X^2$ are sulfur, $X^1$ is oxygen, $R^{11}$ is $C_3$–$C_8$-alkyl, n* is 2, m is 1 and M is $Zn^{2+}$ 12. A composition according to claim 1, wherein, in the formula III, X, $X^1$ and $X^2$ are oxygen, $R^{11}$ is $C_2$–$C_6$-alkyl, n* is 1 or 2, m is 2 or 1 and M, in the case of m=1, is $HN^{\oplus}(R^{13})(R^{14})(R^{15})$ and, in the case of m=2, is $HN^{\oplus}(R^{14})$ $(R^{15})$ or a proton, with the proviso that at most one radical M is a proton.

13. A composition according to claim 1, wherein the mixture (b) consists of (1) one compound of the formulae I or II and (2) one compound of the formula III.

14. A composition according to claim 13, wherein, in the compounds of the formulae I or II, a has the value 0, Y is sulfur or oxygen and, in the formula I, $R^1$ is hydrogen and, in the compounds of the formula III, X, $X^1$ and $X^2$ are oxygen, $R^{11}$ is $C_2$–$C_6$-alkyl, n* is the number 1 or 2, m is the number 2 or 1 and M, in the case of m=1, is $HN^{\oplus}(R^{13})(R^{14})(R^{15})$ and, in the case of m=2, is $HN^{\oplus}(R^{13})(R^{14})(R^{15})$, or a proton with the proviso that at most one radical M is a proton.

15. A composition according to claim 13, wherein, in the compounds of the formulae I or II, a has the value 1 to 1.25, Y is sulfur or oxygen and, in the formula I, $R^1$ is hydrogen, and, in the compounds of the formula III, X and $X^2$ are sulfur, $X^1$ is oxygen, $R^{11}$ is $C_3$–$C_8$-alkyl, n* is the number 2, m is the number 1 and M is $Zn^{2+}$.

16. A composition according to claim 1, wherein the mixture (b) consists of (1) one compound of the formula I and (2) one compound of the formula III.

17. A composition according to claim 16, wherein, in the compounds of the formula I, a has the value 1 to 1.25, Y is sulfur, $R^1$ is hydrogen, $R^2$ is hydrogen, $R^3$ is hydrogen or $C_8$–$C_{24}$-alkyl and $R^4$ is $C_8$–$C_{24}$-alkyl and, in the compounds of the formula III, X and $X^2$ are sulfur, $X^1$ is oxygen, $R^{11}$ is $C_3$–$C_8$-alkyl, n* is the number 2, m is the number 1 and M is $Zn^{2+}$.

18. Process of inhibiting the wear of lubricants or hydraulic oils which consists essentially of incorporating 1) at least one compound of the formulae I or II and 2) at least one compound of the formulae III or IV, according to claim 1, as wear-reducing additives to lubricants or hydraulic oils.

* * * * *